United States Patent [19]

Harada

[11] 3,981,278

[45] Sept. 21, 1976

[54] PROTECTION APPARATUS FOR REMOTELY CONTROLLED SELF-REVERSING MARINE ENGINES

[75] Inventor: Noboru Harada, Mihara, Japan

[73] Assignee: Mitsubishi Heavy Industries, Inc., Tokyo, Japan

[22] Filed: Feb. 6, 1975

[21] Appl. No.: 547,452

Related U.S. Application Data

[63] Continuation of Ser. No. 399,559, Sept. 21, 1973, abandoned.

[52] U.S. Cl. ..... 123/41 R; 123/41 E

[51] Int. Cl.[2] ..... F01L 13/02

[58] Field of Search ..... 123/41 E, 41 R

[56] References Cited

UNITED STATES PATENTS

| | | | |
|---|---|---|---|
| 2,477,836 | 8/1949 | Stevens | 123/41 R |
| 2,635,417 | 4/1953 | Brooks | 123/41 R |
| 3,282,259 | 11/1966 | Moor | 123/41 R |

*Primary Examiner*—Charles J. Myhre
*Assistant Examiner*—William C. Anderson
*Attorney, Agent, or Firm*—R. S. Visk; R. W. McIntire, Jr.

[57] ABSTRACT

Apparatus for protecting reversible engines against damage during reversal of engine rotation notwithstanding that such reversal is initiated remotely by the operator by a single movement of the control handle without regard of the engine speed at the time such reversal is initiated, said apparatus including means for automatically cutting off engine throttle, determining the engine speed and direction of rotation at time reversal operation is initiated, and delaying, if necessary, restarting of the engine in the desired direction of rotation until rotation in the prior direction has been reduced to a safe speed for effecting such rotational reversal.

8 Claims, 2 Drawing Figures

PROTECTION APPARATUS FOR REMOTELY CONTROLLED SELF-REVERSING MARINE ENGINES

Figure 1:
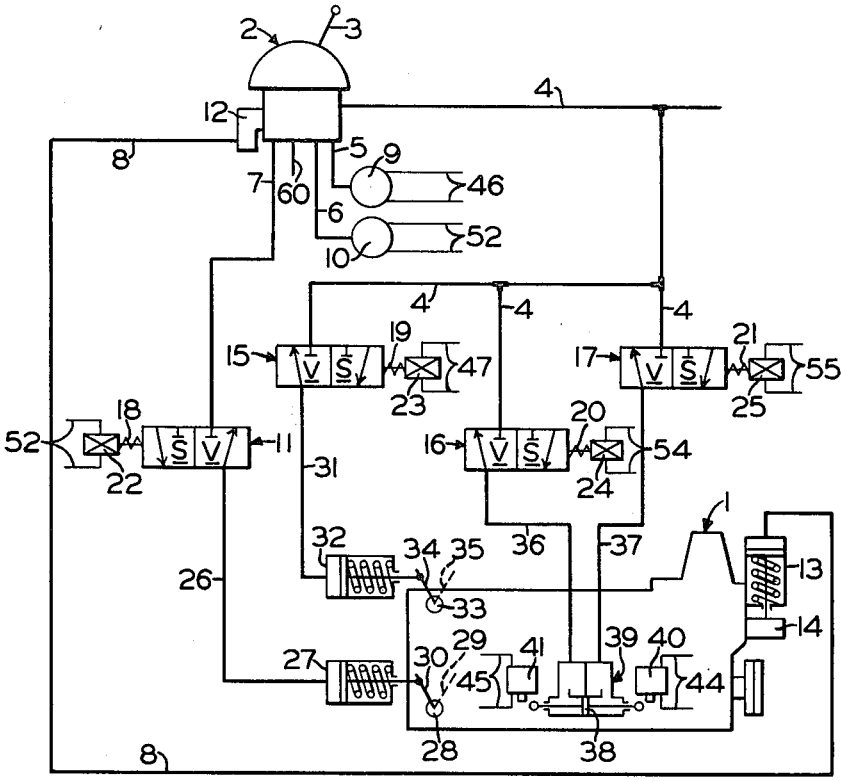

This is a continuation of application Ser. No. 399,559, filed Sept. 21, 1973 which is now abandoned.

BACKGROUND OF THE INVENTION

With the use of certain engines, particularly reversible marine engines, which are capable of running either in a forward or a reverse direction for propelling the vessel accordingly, it is necessary to use extreme care in assuring that the engine has stopped running in one direction or at least slowed down to a safe rate of rotation before an attempt is made to reverse and restart the engine for propelling the vessel in an opposite direction. Since operation of a marine vessel and its engine is normally controlled by a controller usually located on the boat at a point remote from the engine house, the operator must rely on experience or perhaps indicating means, such as visual instruments, for apprising him when to make each move of the controller handle when desiring to reverse direction of rotation of the engine. Such movements may require the operator to first place the handle in an engine stop position, then, after checking the instruments to assure himself that the engine has stopped, move the handle to the start position for initiating the opposite direction of rotation, and finally into the desired speed position. With such a control apparatus, where so much attentiveness, reliance on instruments, and manipulation of the controller handle is required of the operator, the possibilities of resultant damages from movement of the controller handle into one of the required positions, perhaps in reliance on information indicated on a faulty instrument, before the rotating condition of the engine is compatible with the operation called for by the handle position, are greatly increased.

SUMMARY OF THE INVENTION

The object of the present invention therefore, is to provide protective apparatus for preventing damage to a remotely controlled reversible marine engine and drive means associated therewith, notwithstanding inadvertent operation of the controller handle by the operator to a position not compatible with the rotating condition of the engine.

Briefly, the invention, which is intended for use with a reversible marine engine and the fluid pressure control system attendant with such an engine, including valve devices for supplying actuating pressure to the several operating devices for engine starting, stopping, speed setting, reversing, etc., comprises an electrical control system for controlling operation of the fluid pressure system, said electrical control system including a plurality of circuits for sensing a stopped or running condition of the engine and the speed thereof, if running, for delaying restarting of the engine, when an engine reversing operation for reversing the direction of travel of the vessel has been initiated by the operator, until the engine speed is reduced to a safe degree for effecting such reversal operation, and for automatically restarting the engine and setting the throttle for the desired speed in the direction of travel selected when the running condition of the engine is such as to permit the reversing operation without damage.

Figure 2:
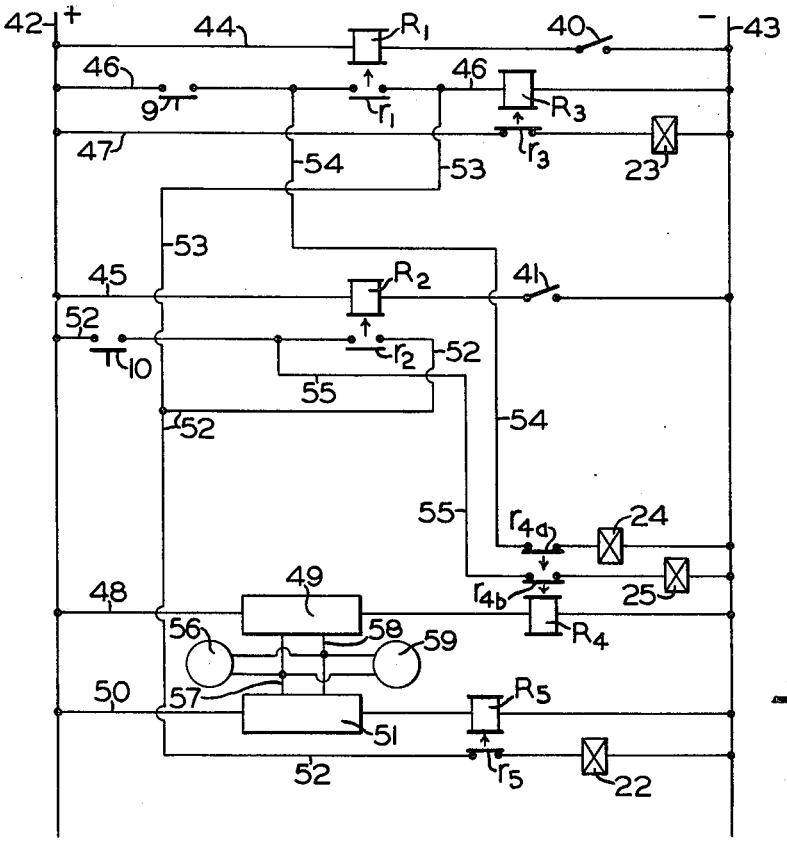

In the drawing,

FIG. 1 is a schematic view of a fluid pressure system for controlling operation of a reversible marine engine; and FIG. 2 is a schematic view of an electrical control system for the fluid pressure system shown in FIG. 1.

DESCRIPTION AND OPERATION

As shown in FIG. 1, a fluid pressure operable control system for reversing the direction of rotation of a marine engine 1 comprises an operator's controller 2, including an operating handle 3, mounted at some convenient location on the boat remote from the engine room. The inlet side of controller 2 is connected to a fluid pressure supply pipe or conduit 4. Handle 3, in conventional manner, is selectively operable out of a neutral position to either a forward drive zone or a reverse drive zone, the speed of the engine being determined by the extent to which said handle is moved into the selected zone.

Controller 2 is provided with several outlets connected to pipes or conduits 5, 6, 7, and 8, respectively, said outlets being selectively communicable with supply pipe 4, depending upon the position of handle 3. Pipes 5 and 6 are connected to forward and reverse pressure switches 9 and 10, respectively, while pipe 7 is connected to a switching valve device 11, represented symbolically in FIG. 1 of the drawing. Pipe 8 interconnects a pressure relay valve device 12, forming a component of the operator's controller 2, with an operating cylinder 13 which serves to operate a throttle 14 for determining the speed of engine 1. Supply pipe 4 is also connected by respective branches to switching valve devices 15, 16, and 17, also represented symbolically in the drawing.

Each of the switching valve devices 11, 15, 16, and 17 are normally biased by respective springs 18, 19, 20, and 21 to respective vent positions, to be hereinafter defined, in which they are shown and designated V in the drawing. Switching valve devices 11, 15, 16, and 17 are operable, in a manner to be hereinafter disclosed, to supply positions, designated S in the drawing and to be hereinafter defined, by solenoids 22, 23, 24 and 25, respectively.

Switching device 11 is connected by a pipe or conduit 26 to a starter motor actuating cylinder 27 which serves to control operation of a starter switch 28 for the starter motor (not shown). Since a detailed description of the starter motor and switch 28 is not deemed essential to an understanding of the invention, it will suffice to say that said starter switch, when operated to an engine starting or start position represented by a broken line 29 in the drawing, actuates a driving motor (not shown) for cranking the engine 1, which may be a diesel type engine, for example, from a stopped disposition to a running disposition. Actuating cylinder 27, in the absence of fluid pressure acting thereon when switching valve device 11 is in its vent position V, occupies a normal position in which starter switch 28 is operated to a neutral or cut-out position, represented by a solid line 30 in the drawing, in which cut-out position the starter motor is shut down, since as in the case of internal combustion or diesel engines, for example, the engine is capable of self-sustaining operation after attainment of a certain rate of running speed. Energization of solenoid 22 effects operation of switching valve device 11 to its supply position S in which pipe 26 is communicated with pipe 7 for supplying fluid pressure, via operator's controller 2 when handle 3 is in either a forward starting or reverse starting position, it being immaterial as far as the engine-starting operation is concerned to cylinder 27 for effecting operation of starter switch 28 to its start position 29.

Switching valve device 15 is connected via a pipe or conduit 31 to a fuel valve operating cylinder 32 for operating a fuel valve 33 either to a normally fully open position, indicated by a solid line 34, or to a fully closed position indicated by a broken line 35, there being no intermediate positions of said fuel valve between said open and closed positions. Switching valve device 15, solenoid 23, and operating cylinder 32 cooperate in similar fashion as that described in connection with switching valve device 11, solenoid 22, and cylinder 27. That is, when fluid pressure is vented from operating cylinder 32, fuel valve 33 is operated to its open position, and when said operating cylinder is subjected to fluid pressure, in this case from supply pipe 4, said fuel valve is operated to its closed position. This will be more fully explained hereinafter.

Switching valve devices 16 and 17 are connected via pipes or conduits 36 and 37 to opposite sides, left and right respectively as viewed in FIG. 1, of a piston 38 reciprocably operable in a double acting cylinder 39 and having respective stems extending axially from opposite sides thereof, said stems serving to alternatively open or close one or the other of a pair of switches 40 and 41 as well as being engageable with and alternatively effecting operation of a conventional engine-reversing device (not shown) to one or the other of forward and reverse positions in which the engine 1 rotates in one direction or the other to effect forward or reverse travel of the vessel, respectively. Piston 38 is biased, by means not shown, to a central neutral position out of engagement with both switches 40 and 41 and the engine-reversing device. Switches 40 and 41 may be of the self-locking type and have operatively associated therewith electrical means such as respective stick circuits (not shown), for example, so that if switch 40, for example is operated to its closed position, it will automatically be maintained in said closed position by its respective stick circuit, notwithstanding that fluid pressure may be vented from the left side of piston 38 (which then resumes its neutral position) until switch 41 is operated to its closed position, whereupon the stick circuit for switch 40 is deenergized and switch 40 is released from its closed position to assume its open position.

Switching valve devices 16 and 17, solenoids 24 and 21, and operating cylinder 39 also cooperate in a manner generally similar to that discussed in connection with switching valve devices 11 and 15, solenoids 22 and 23, and operating cylinders 27 and 32 with respect to supply and venting of fluid pressure to and from the left and right sides, respectively, of piston 38, said manner of operation to be more fully discussed hereinafter.

The control portion of the protection apparatus, as shown in FIG. 2, for controlling operation of the fluid pressure portion shown in FIG. 1 comprises several interlocked electrical circuits which are interconnected in parallel relation with each other via a main circuit comprising a positive (+) or supply conductor 42 and a negative (−) or ground conductor 43.

A forward-driving detector circuit comprises a conductor 44 connected at opposite ends to conductors 42 and 43 and having serially interposed therein an electrical relay $R_1$ and switch 40. A reverse-driving detector circuit comprises a conductor 45 connected at opposite ends to conductors 42 and 43 and having serially interposed therein an electrical relay $R_2$ and switch 41.

A fuel valve control circuit for controlling operation of fuel valve 33 comprises a conductor 46 connected at opposite ends to conductors 42 and 43 and having serially interposed therein pressure switch 9, a connector member $r_1$ operably controlled by relay $R_1$, and a fuel valve control relay $R_3$. The fuel valve control circuit cooperates with a fuel valve actuating circuit comprising a conductor 47 connected at opposite ends to conductors 42 and 43 and having serially interposed therein a connector member $r_3$ operably controlled by relay $R_3$, and solenoid 23, to effect operation of fuel valve 33.

An engine stoppage detector circuit for detecting reduction of engine speed to a rate less than a certain predetermined rate comprises a conductor 48 connected at opposite ends to conductors 42 and 43 and having serially interposed therein an engine stoppage detector device 49 and a relay $R_4$. For purposes of this invention, the engine is considered to be "stopped" and reversal of the drive system may be effected without causing damage thereto, when engine speed has reduced to 10 rpm or less. The engine stoppage detector device 49, which may be of any suitable conventional type responsive to a speed signal, is pre-set to cause the engine stoppage circuit to be normally open when the speed of engine 1 has reduced to 10 rpm or less, and thereby deenergize relay $R_4$ and close connector members $r_{4a}$ and $r_{4b}$, which are normally biased to respective closed positions, or to cause said circuit to be closed when engine speed exceeds 10 rpm for closing said circuit for energizing relay $R_4$ and operating said connector members to respective open positions.

A starter motor cut-out circuit is provided for detecting engine speed at a rate above a certain predetermined rate, such as 80 rpm for example, at which the engine is considered to have attained a self-sustaining running speed, and the starting motor may be automatically cut out by operation of the starter switch 28 to its neutral or cut-out position. The starter motor cut-out circuit comprises a conductor 50 connected at opposite ends to conductors 42 and 43 and having serially connected therein a normal speed detector device 51 and a relay $R_5$. When engine speed attains a normal speed of at least 80 rpm, speed detector 51, which may be of any suitable conventional type, effects closing of the starter motor cut-out circuit, which causes relay $R_5$ to be energized for a purpose to be hereinafter explained.

A first starter motor actuating circuit for controlling actuation of starter switch 28 to its engine starting position comprises a conductor 52 connected at opposite ends to conductors 42 and 43 and has serially connected therein pressure switch 10, connector member $r_2$, a connector member $r_5$ controlled by relay $R_5$, and solenoid 22. A second starter motor actuating circuit comprises conductor 46 and a conductor 53 having one end connected to conductor 46 between connector member $r_1$ and relay $R_3$, and the other end connected to conductor 52 between connector member $r_2$ and connector member $r_5$.

A forward direction circuit for effecting operation of the engine-reversing device (not shown) to its forward position, above described, comprises a portion of the conductor 46 adjacent the end connected to conductor 42, pressure switch 9, a branch conductor 54 having one end connected to conductor 52 between pressure switch 9 and connector member $r_1$ and the other end connected to conductor 43, said branch conductor having serially connected therein connector member $r_{4a}$, operably controlled by relay $R_4$, and solenoid 24.

A reverse direction circuit comprises a portion of conductor 52 adjacent the end connected to conductor 42, pressure switch 10, a branch conductor 55 having one end connected to conductor 52 between pressure switch 10 and connector member $r_2$, said branch conductor having serially connected therein connector member $r_{4b}$, operably controlled by relay $R_4$, and the solenoid 25.

A speed transmitter device 56 constantly transmits the prevailing speed rate of engine 1 to both the stoppage detector device 49 and the normal speed detector device 51 via conductors 57 and 58, respectively, said speed transmitter device being connected to a speed indicator or meter 59, if desired.

In considering the operation of the protection apparatus, let it be assumed that the boat is traveling in a forward direction at a normal speed. Under these conditions, the speed of engine 1 is assumed to be in excess of 80 rpm, and normally deenergized relay $R_4$ (at engine speed of 10 rpm or less) is, therefore, energized, as hereinbefore noted, so that both connector members $r_{4a}$ and $r_{4b}$ are in their respective open positions. Both solenoids 24 and 25 are deenergized so that both switching devices 16 and 17 are in their respective vent positions V and, therefore, both sides of piston 38 are free of fluid pressure with the result that piston 38 assumes its neutral position. Switch 40, however, due to the stick circuit associated therewith being energized, remains in its closed position until released therefrom when switch 41 is operated to its closed position, as was hereinbefore noted.

Also, with the boat driving in a forward direction and with switch 40 closed, relay $R_1$ is energized and connector member $r_1$ is in a closed position in which, with pressure switch 9 in its closed position, relay $R_3$ is energized and connector member $r_3$ is in an open position so that normally energized solenoid 23 is deenergized. When solenoid 23 is deenergized, switching valve device 15 occupies its vent position V, in which it is shown in FIG. 1, so that fuel valve operating cylinder 32 is vented and fuel valve 33 is in its open position 34 to provide fuel for the engine 1.

Moreover, it may also be assumed that, with the boat traveling in a forward direction at a normal speed, the engine speed is in excess of 80 rpm and, therefore, normal speed detector 51 causes the circuit comprising conductor 50, speed detector 51, and relay $R_5$ to be closed, so that said relay is energized and connector member $r_5$ is in its open position, and solenoid 22 is deenergized. When solenoid 22 is deenergized, switching valve device 11 is in its vent position in which it is shown and in which starter valve operating cylinder 27 is thereby vented. Starter valve 28, therefore, occupies its cut-out position 30 in which the starter motor (not shown) is cut out while the boat is traveling at a normal speed.

When the boat is traveling in a forward direction, if it is desired to reverse the direction of travel, the operator moves handle 3 of controller 2 from a forward driving position to a reverse driving position, whereupon actuating fluid pressure acting on pressure switch 9 is released therefrom via pipe 5 and a vent 60 in said controller, and actuating fluid pressure is supplied to pressure switch 10 via pipe 6, said switches 9 and 10 thus assuming open and closed positions, respectively.

Notwithstanding that pressure switch 9 is now open, switch 40 temporarily remains in its closed position (until switch 41 is operated to its closed position, as hereinbefore explained), and therefore relay $R_1$ remains energized to keep connector $r_1$ closed. But since pressure switch 9 is now open, relay $R_3$ is deenergized thereby allowing connector $r_3$ to assume a closed position in which solenoid 23 becomes energized. Energization of solenoid 23 causes switching valve 15 (see FIG. 1) to be operated to its supply position S in which fluid pressure supplied via pipe 4 is delivered to fuel valve operating cylinder 32 via pipe 31 for effecting operation of fuel valve 33 to its closed position. With fuel valve 33 closed, fuel to engine 1 is cut off, and the engine begins to lose speed. when the speed of engine 1 drops to less than 80 rpm, rotation detector 51 opens the circuit in which relay $R_5$ is interposed thereby resulting in deenergization of said relay and closing of connector $r_5$ to condition the circuit for energizing solenoid 22. Solenoid 22, however, which controls operation of switch valve 11 and, therefore, operating piston 27 and starter valve 28, remains deenergized until switch 41 is closed. Although not shown, clutch means for disengaging the engine from the propeller shaft during engine reversal operation, could comprise electro-magnetically operable clutch means tied in with the rotation detector 51 so that said clutch means would be disengaged when engine speed is reduced to 80 rpm or less and re-engaged when engine speed picks up to 80 rpm or more.

When the speed of engine 1, which is now cut off from the fuel supply, drops to 10 rpm or less, speed detector 49 causes the circuit in which said detector and relay $R_4$ are connected to be opened, thereby deenergizing said relay and causing connectors $r_{4a}$ and $r_{4b}$ to be closed. Since pressure switch 9 is open, closing of connector $r_{4a}$, therefore, does not result in energization of solenoid 24. But, with pressure switcch 10 and connector $r_{4b}$ both closed, solenoid 25 is energized and switching valve 17 is operated to its supply position S in which fluid pressure from supply pipe 4 is delivered via pipe 37 to the right side of piston 38 to effect closing of switch 41, whereupon switch 40 is restored to its open position, as hereinbefore explained.

With closing of switch 41, relay $R_2$ becomes energized and connector $r_2$ is closed. When connector $r_2$ is closed, the circuit comprising pressure switch 10, the portion of conductor 52 adjacent the end connected to conductor 42, connector $r_2$, conductor 53, relay $R_3$, and the portion of conductor 46 adjacent the end connected to conductor 43, is closed to cause energization of relay $R_3$ and, therefore, opening of connector $r_3$. When connector $r_3$ is opened, solenoid 23 is deenergized and, therefore, switching valve 15 is operated to its vent position V in which operating cylinder 32 is relieved of fluid pressure and fuel valve 33 is operated to its open position.

At the same time, with connector $r_2$ in its closed position and pressure switch 10 closed, solenoid 22 becomes energized, because, as was previously noted, connector $r_5$ was operated to its closed position when relay $R_5$ was deenergized as a result of engine speed previously dropping to less than 80 rpm. With solenoid 22 energized, switching valve 11 is operated to its supply position S to effect supply of fluid pressure from pipe 7 to starter valve operating cylinder 27 via pipe 26 and consequent operation of starter switch 28 to its engine starting position in which running of engine 1 is resumed.

After engine 1 attains a speed in excess of 10 rpm, speed detector 49 closes the circuit in which it and relay $R_4$ are connected to thereby cause said relay to be energized and, therefore, connectors $r_{4a}$ and $r_{4b}$ to be opened. As was previously noted, solenoid 24 at this time is already deenergized so that the left side of piston 38 is free of fluid pressure (see FIG. 1). With opening of connector $r_{4b}$, solenoid 25 is also deenergized with consequent operating of switching valve 17 to its vent position V and release of fluid pressure from the right side of piston 38.

With both sides of piston 38 free of fluid pressure, said piston assumes its neutral position, but switch 41 remains in its closed position, as hereinbefore explained.

When engine 1 attains a speed exceeding 80 rpm, the speed at which the engine is presumed to continue running without further aid of the starter motor, speed detector 51, in response to said speed in excess of 80 rpm, causes the circuit in which said detector and relay $R_5$ are interposed, to be closed, thereby effecting energization of said relay, consequent opening of connector $r_5$, and deenergization of solenoid 22. With deenergization of solenoid 22, switching valve 11 is restored to its vent position V, starter valve operating cylinder 27 is relieved of fluid pressure, and starter switch 28 is restored to its cut-out position.

When the boat is traveling in a reverse direction, if it is desired to change the direction of travel again to the forward direction, the operator simply moves handle 3 of controller 2 to the forward drive position which will actuate the control apparatus to effect the reversing procedure in manner similar to that described above when the direction of travel was changed from forward to reverse.

It should be evident from the above description of operation of the protection apparatus embodying the invention that it is immaterial to what degree of speed the operator sets the handle 3 when initiating a change of travel, or even if he inadvertently changes the handle position from one direction to another, the sequential phases of operation in effecting such change of direction occur in orderly and logical fashion as controlled by the control portion of interlocked circuits shown in FIG. 2.

Having now described my invention, what I claim as new and desire to secure by Letters Patent is:

1. Protection apparatus for remotely controlled reversible marine engines for marine vessels including drive means therefor, engine starting means, speed control means, an operator's controller selectively operable to a plurality of forward or reverse positions for effecting forward or reverse travel, engine starting and speed of the vessel according to the controller position selected, and control means operable responsively to operation of said operator's controller to a selected position, said control means including:

a. first means actuable responsively to operation of said operator's controller from any one of said plurality of forward or reverse positions to a selected opposite position for reversing engine rotation by sequentially shutting down the engine, reducing the rotational speed thereof, and setting the engine for forward or reverse rotation according to the position selected;

b. second means actuable responsively to actuation of said first means, with said operator's controller remaining in said opposite position, for effecting engine restarting subsequently to reduction of engine speed to less than a certain low rate and setting thereof for the selected direction of rotation;

c. third means actuable responsively to actuation of said first and second means for effecting engine speed according to the selected opposite position of the operator's controller subsequently to said engine restarting, and wherein the improvement comprises:

d. fourth means for delaying said engine restarting and consequent reversal of direction of travel of the vessel until engine speed has reduced to said certain low rate, notwithstanding operation of said operator's controller from one of said forward or reverse positions directly to said opposite position without delay.

2. Protection apparatus for remotely controlled reversible marine engines for marine vessels, as set forth in claim 1, wherein said engine starting means includes a starter switch operable by said second means to a start position for effecting engine starting, said apparatus including fifth means operable responsively to engine speed in excess of a certain high rate for effecting deactuation of said second means and operation of said starter switch to a cut-out position in which the engine runs independently of the starting means.

3. Protection apparatus for remotely controlled reversible marine engines for marine vessels, as set forth in claim 2, wherein:

a. said first means comprises:

i. fluid pressure operable double acting cylinder means for setting the engine for forward or reverse rotation and having oppositely disposed pressure areas alternatively subjectable to fluid pressure for operating the cylinder means to a forward or reverse position in which the engine is rotated in a direction corresponding to the pressure area subjected to fluid pressure;

ii. first solenoid operated valve means selectively energizable, according to the selected position of the operator's controller, for alternatively effecting supply of fluid pressure to one or the other of said pressure areas;

iii. first electrical circuit means including fluid pressure operable switch means actuable responsively to operation of said operator's controller to said selected position for closing said circuit means to effect energization of the solenoid operated valve means accordingly.

4. Protection apparatus for remotely controlled reversible marine engines for marine vessels, as set forth in claim 3, wherein said first means includes respective normally closed connectors in said first electrical circuit means for effecting energization of said first solenoid-operated valve means respectively, and wherein said fourth means comprises:

a. an electrical low engine speed detector circuit having serially connected therein:

i. a low speed electrical relay device; and ii. a low speed detector device operable responsively to engine speeds less than said certain low rate for opening said low speed detector circuit and to engine speeds in excess of said certain low rate for closing the low speed detector circuit and effecting energization of said low speed relay device, b. said low speed relay device being effective, when energized, for opening said connectors and causing said first solenoid-operated valve means to be deenergized for causing both said pressure areas to be relieved of fluid pressure during such time that engine speed is less than said certain low rate.

5. Protection apparatus for remotely controlled reversible marine engines for marine vessels, as set forth in claim 4, wherein:

a. said first solenoid-operated valve means comprises:

i. a forward engine rotation operating valve device operable to a supply position and a vent position for effecting supply and release of fluid pressure to and from, respectively, one of said oppositely disposed pressure areas;

ii. a forward engine rotation solenoid effective, when energized, for operating said forward engine rotation operating valve device to its supply position and, when deenergized, for operating said forward engine rotation operating valve device to its vent position;

iii. a reverse engine rotation operating valve device operable to a supply position and a vent position for effecting supply and release of fluid pressure to and from, respectively, the other of said pressure areas; and iv. a reverse engine rotation solenoid effective, when energized, for operating said reverse engine rotation operating valve device to its supply position and, when deenergized, for operating said reverse engine rotation operating valve device to its vent position;

b. said first electrical circuit means comprises:

i. a forward travel circuit having serially connected therein said forward engine rotation solenoid and one of said connectors, said forward travel circuit being effective, when closed, for energizing the forward engine rotation solenoid;

ii. a reverse travel circuit having serially connected therein said reverse engine rotation solenoid and the other of said connectors, said reverse travel circuit being effective, when closed, for energizing the reverse engine rotation solenoid; and c. said fluid pressure operable switch means comprises:

i. a forward travel fluid pressure operable switch interposed in said forward travel circuit and operable to a closed position responsively to operation of the operator's controller to a forward position; and ii. a reverse travel fluid pressure operable switch interposed in said reverse travel circuit and operable to a closed position responsively to operation of the operators 's controller to a reverse position.

6. Protection apparatus for remotely controlled reversible marine engines for marine vessels, as set forth in claim 5, wherein said second means comprises:

a. a forward travel detector electrical circuit having serially connected therein:

i. a forward travel electrical relay; and ii. a forward travel switch member operable, in response to operation of said cylinder means to its said forward position, to a closed position in which said forward travel detector circuit is closed for causing the forward travel relay to be energized;

b. a first engine starter electrical circuit having serially connected therein:

i. said forward travel fluid pressure operable switch;

ii. a first connector operable from a normally open position to a closed position responsively to energization of said forward travel relay;

iii. a second connector normally occupying a closed position; and iv. a starter solenoid energizable upon closing of said first engine starter circuit responsively to closing of said forward travel fluid pressure operable switch and said first connector;

c. a reverse travel detector electrical circuit having serially connected therein:

i. a reverse travel electrical relay; and ii. a reverse travel switch member operable, in response to operation of said cylinder means to its said reverse position, to a closed position in which said reverse travel detector circuit is closed for causing the reverse travel relay to be energized;

d. a second engine starter electrical circuit having serially connected therein:

i. said reverse travel fluid pressure operable switch;

ii. a third connector operable from a normally open position to a closed position responsively to energization of said reverse travel relay;

iii. said second connector; and iv. said starter solenoid energizable upon closing of said second engine starter circuit responsively to closing of said reverse travel fluid pressure operable switch and said third connector;

e. said first and second engine starting circuits being alternatively closed by selective closing of said forward and reverse travel fluid pressure operable switches according to the selected position of the operator's controller; and f. said starter solenoid being effective, when energized, for causing said engine starting means to operate said starter switch to its said start position.

7. Protection apparatus for remotely controlled reversible marine engines for marine vessels, as set forth in claim 6, wherein said fifth means comprises:

a. an electrical high engine speed detector circuit having serially connected therein:

i. a high speed electrical relay device; and ii. a high speed detector device operable responsively to engine speeds in excess of said certain high rate for closing said high engine speed detector circuit and effecting energization of said high speed relay device, b. said high speed relay device being effective, when energized, for operating said second connector to an open position in which both said first and said second engine starting circuits are opened, notwithstanding which one may be closed at the time, and causing deenergization of said starter solenoid and consequent operation of said starter switch to its said cut-out position.

8. Protection apparatus for remotely controlled reversible marine engines for marine vessels, as set forth in claim 7, wherein said first means further comprises:

a. fuel valve means having an open position, in which fuel may be supplied to the engine while running, and being operable to a closed position in which fuel supply is cut-off from the engine;

b. an electrical fuel valve operating circuit having serially connected therein:

i. a fuel valve operating solenoid effective, when deenergized, for operating said fuel valve means to its said open position and, when energized, for operating said fuel valve means to its said closed position; and ii. a fourth connector effective in a closed position for closing said fuel valve operating circuit and causing energization of said fuel valve operating solenoid, and being effective in an open position for opening said fuel valve operating circuit and causing deenergization of said fuel valve operating solenoid; and c. a fuel valve electrical relay device interposed in parallel relation in said first and second engine starter circuits and being energizable, when either of said first and second engine starter circuits is closed, for operating and holding said fourth connector in its said open position.

* * * * *